US010711448B2

(12) United States Patent
Emborg

(10) Patent No.: US 10,711,448 B2
(45) Date of Patent: Jul. 14, 2020

(54) STORM WATER DELAY DEVICE

(71) Applicant: Rockwool International A/S, Hedehusene (DK)

(72) Inventor: Michaeel Emborg, Kirke Saaby (DK)

(73) Assignee: ROCKWOOL INTERNATIONAL A/S, Hedehusene (DK)

( * ) Notice: Subject to any disclaimer, the term of this patent is extended or adjusted under 35 U.S.C. 154(b) by 169 days.

(21) Appl. No.: 14/422,403

(22) PCT Filed: Aug. 23, 2013

(86) PCT No.: PCT/EP2013/067551
§ 371 (c)(1),
(2) Date: Feb. 19, 2015

(87) PCT Pub. No.: WO2014/029872
PCT Pub. Date: Feb. 27, 2014

(65) Prior Publication Data

US 2015/0247313 A1 Sep. 3, 2015

(30) Foreign Application Priority Data

Aug. 24, 2012 (EP) ..... 12181813

(51) Int. Cl.
*E03F 5/10* (2006.01)

(52) U.S. Cl.
CPC ..... *E03F 5/10* (2013.01); *E03F 5/101* (2013.01); *Y10T 29/49826* (2015.01)

(58) Field of Classification Search
None
See application file for complete search history.

(56) References Cited

U.S. PATENT DOCUMENTS 3,352,423 A 11/1967 Osterman
3,415,384 A 12/1968 Kasten
5,015,123 A * 5/1991 Houck ..... E02B 11/00 405/36

(Continued)

FOREIGN PATENT DOCUMENTS

EP 1961291 8/2008
WO 9707684 3/1997

(Continued)

*Primary Examiner* — Craig M Schneider
*Assistant Examiner* — David R Deal
(74) *Attorney, Agent, or Firm* — Tarolli, Sundheim, Covell & Tummino LLP

(57) ABSTRACT

The present invention relates to a device comprising a coherent manmade vitreous fibre substrate (MMVF substrate) and at least one first conduit (2) and at least one second conduit (3), each conduit having first and second open ends, wherein the MMVF substrate (1) comprises man-made vitreous fibres bonded with a cured binder composition, wherein the first open end of the first conduit and the first open end of the second conduit are each independently in fluid communication with the MMVF substrate, wherein the first conduit is at a greater height than the second conduit, wherein at least a portion of the MMVF substrate is disposed between the first and second conduits. The MMVF substrate provides for an increased water storage ability due to the hydrophilic behaviour of the substrate and its increased surface.

19 Claims, 4 Drawing Sheets

(56) References Cited

U.S. PATENT DOCUMENTS

| | | | | |
|---|---|---|---|---|
| 5,788,409 | A * | 8/1998 | Johnson | E03F 1/002 210/170.08 |
| 6,095,718 | A | 8/2000 | Bohnhoff | |
| 6,267,882 | B1 * | 7/2001 | Houck | B01D 24/007 210/170.08 |
| 6,389,748 | B1 * | 5/2002 | De Groot | A01G 31/001 47/64 |
| 2009/0045145 | A1 * | 2/2009 | Kent | B01D 39/2089 210/767 |
| 2011/0255921 | A1 | 10/2011 | Obermeyer | |

FOREIGN PATENT DOCUMENTS

| | | |
|---|---|---|
| WO | 0123681 | 4/2001 |
| WO | 2007129202 | 11/2007 |

* cited by examiner

STORM WATER DELAY DEVICE

FIELD OF THE INVENTION

The present invention relates to a storm water delay device, the use of a storm water delay device, a method of installing a storm water delay device and a method of delaying the arrival of water at a water collection point.

BACKGROUND OF THE INVENTION

Precipitation such as rain, snow, sleet, hail and the like can be collected in reservoirs or tanks and then can be treated and used as mains water. Drainage systems can be set up, separate from sewage systems, to collect such water from precipitation. Water from precipitation requires less treatment before it can be used as mains water than is required by water from sewage systems and it is therefore desirable to collect water from precipitation separately from water from sewage systems. Water from precipitation can be collected separately from water from sewage systems by directing water that has been collected in guttering of buildings down drainpipes and piping it to storage tanks or reservoirs. The capacity of such a drainage system as at risk of being overwhelmed with water during storms and it is consequently desirable to prevent an excessive amount of water arriving at a reservoir or tank. The arrival of a large volume of water in a short period of time can cause localised flooding.

It is known to use water attenuation tanks to store storm water, and then gradually release the water to a reservoir or other tank. These are costly to install since they are often made of concrete or steel and the delivery costs and the installation time are high. There is also the need for continual maintenance to ensure that the water is released to the reservoir or other tank at the required time. The water can be released by manual intervention, or by an automated system.

US2011/0255921 A1 discloses a storm water retention cell containing an assembly of hollow frustrum-shaped bodies arranged and supported on a horizontal support. The assemblies are arranged in alternately invert layers with the ends of the frustrum-shaped bodies interconnected to form vertical support columns within the cell which are horizontally stabilised by horizontal support structure. The aim is to collect and store storm water.

U.S. Pat. No. 6,095,718 discloses a container for receiving and storing fluids gathered and discharged from a drainage structure. The container comprises an impermeable plastic envelope around a supporting framework of at least two vertically stacked laterally extensive mats. Each mat comprises a backing grid having a plurality of intersecting struts defining grid openings therebetween; and a plurality of spaced support members projecting from said backing grid, whereby fluid may flow vertically through said backing grid and laterally between said support members. The aim is to collect and store water in the container. Such containers are often structurally unstable and relatively expensive to manufacture and install, thus limiting their practical utility.

A further solution is to provide a device containing a pipe which takes a long route through the device by undulating back and forth through the device. This device slows the movement of the water to the reservoir by increasing the distance traveled by the water to reach the reservoir or tank. It is essential that the pipe remains clear as any blockage will prevent the water from reaching the reservoir. Such a device is usually wrapped in a geo-textile material to prevent earth and sediment reaching the device. This requirement adds an additional and difficult step in the installation process.

U.S. Pat. No. 5,788,409 discloses a drain field container system which filters sewage water. The system comprises a distribution box buried beneath the ground for receiving liquid waste from a septic tank. The liquid waste flows from the distribution box via a plurality of pipes to a plurality of drain field containers. The drain field containers are constructed of a sturdy waterproof material. Each drain field container contains a filter made from gravel, crushed stone, pea stone, sand or a filter cartridge constructed using a honeycombed nylon mesh. The sides and top of the container are waterproof so that unfiltered water cannot seep out the container but must pass through the filter to exit the container. The filtered water can then percolate out of the bottom of the container into the earth or be piped into a storm drain. The purpose of the system is to filter sewage water. This document does not discuss the problems associated with handling a large volume of storm water in a short period of time.

There is a need for a storm water delay device which can be easily installed. There is a need for a device which has a reduced likelihood of becoming contaminated with earth from the ground. There is a need for a device which does not need to be controlled to release water, but that releases water without any manual or automated intervention. There is a need for a device that can hold a greater amount of water per unit volume. There is a need for a device which is environmentally acceptable and economical in terms of production, installation and use. The present invention solves these problems.

SUMMARY OF INVENTION

In a first aspect of the invention, there is provided a device comprising a coherent man-made vitreous fibre substrate (MMVF substrate) and at least one first conduit and at least one second conduit, each conduit having first and second open ends, wherein the MMVF substrate comprises man-made vitreous fibres bonded with a cured binder composition, wherein the first open end of the first conduit and the first open end of the second conduit are each independently in fluid communication with the MMVF substrate, wherein the first conduit is at a greater height than the second conduit, wherein at least a portion of the MMVF substrate is disposed between the first and second conduits.

In a second aspect of the invention, there is provided a use of a device according to the first aspect of the invention as a storm water delay device, wherein the device is positioned in the ground in such a way that the first conduit is at a greater height than the second conduit, whereby water flows along the first conduit and is absorbed by the MMVF substrate, and water leaves the MMVF substrate via the second conduit.

In a third aspect of the invention, there is provided a method of installing a storm water delay device, the method comprising positioning a device according to the first aspect of the invention in the ground in such a way that the first conduit is at a greater height than the second conduit, wherein the first conduit is in fluid communication with a source of water and wherein the second conduit is in fluid communication with a water collection point.

In a fourth aspect of the invention, there is provided a method of delaying the arrival of water at a water collection point, the method comprising providing a device according to the first aspect of the invention, positioning the device in the ground in such a way that the first conduit is at a greater height than the second conduit, wherein water flows along the first conduit and is absorbed by the MMVF substrate, and water leaves the MMVF substrate via the second conduit and is conveyed to the water collection point.

DETAILED DESCRIPTION OF THE INVENTION

MMVF substrates are known for numerous purposes, including for sound and thermal insulation, fire protection and in the field of growing plants. When used for growing plants, the MMVF substrate absorbs water to allow plants to grow. When used for growing plants, it is important that the MMVF substrate does not dry out. In the field of growing plants, an MMVF substrate is normally used instead of soil to grow plants. The relative capillarity of soil and an MMVF substrate is not important in the field of growing plants. WO01/23681 discloses the use of MMVF substrate as a sewage filter.

The man-made vitreous fibres (MMVF) can be glass fibres, ceramic fibres, basalt fibres, slag wool, stone wool and others, but are usually stone wool fibres. Stone wool generally has a content of iron oxide at least 3% and content of alkaline earth metals (calcium oxide and magnesium oxide) from 10 to 40%, along with the other usual oxide constituents of MMVF. These are silica; alumina; alkali metals (sodium oxide and potassium oxide) which are usually present in low amounts; and can also include titania and other minor oxides.

Fibre diameter is often in the range of 3 to 20 μm, preferably 3 to 5 μm.

The MMVF substrate is in the form of a coherent mass. That is, the MMVF substrate is generally a coherent matrix of MMVF fibres, which has been produced as such, but can also be formed by granulating a slab of MMVF and consolidating the granulated material. The binder may be any of the binders known for use as binders for coherent MMVF products. The MMVF substrate may comprise a wetting agent.

The MMVF substrate is hydrophilic, that is it attracts water. The MMVF substrate is hydrophilic due to the binder system used. In the binder system, the binder itself may be hydrophilic and/or a wetting agent used.

The hydrophilicity of a sample of MMVF substrate can be measured by determining the sinking time of a sample. A sample of MMVF substrate having dimensions of 100×100×65 mm is required for determining the sinking time. A container with a minimum size of 200×200×200 mm is filled with water. The sinking time is the time from when the sample first contacts the water surface to the time when the test specimen is completely submerged. The sample is placed in contact with the water in such a way that a cross-section of 100×100 mm first touches the water. The sample will then need to sink a distance of just over 65 mm in order to be completely submerged. The faster the sample sinks, the more hydrophilic the sample is. The MMVF substrate is considered hydrophilic if the sinking time is less than 120 s. Preferably the sinking time is less than 60 s. In practice, the MMVF substrate may have a sinking time of a few seconds, such as less than 10 seconds.

When the binder is hydrophobic, in order to ensure that the substrate is hydrophilic, a wetting agent is additionally included in the MMVF substrate. A wetting agent will increase the amount of water that the MMVF substrate can absorb. The use of a wetting agent in combination with a hydrophobic binder results in a hydrophilic MMVF substrate. The wetting agent may be any of the wetting agents known for use in MMVF substrates that are used as growth substrates. For instance it may be a non-ionic wetting agent such as Triton X-100 or Rewopal. Some non-ionic wetting agents may be washed out of the MMVF substrate over time. It is therefore preferable to use an ionic wetting agent, especially an anionic wetting agent, such as linear alkyl benzene sulphonate. These do not wash out of the MMVF substrate to the same extent.

EP1961291 discloses a method for producing water-absorbing fibre products by interconnecting fibres using a self-curing phenolic resin and under the action of a wetting agent, characterised in that a binder solution containing a self-curing phenolic resin and polyalcohol is used. This type of binder can be used in the present invention. Preferably, in use the wetting agent does not become washed out of the MMVF substrate and therefore does not contaminate the surrounding ground.

The binder of the MMVF substrate can be hydrophilic. A hydrophilic binder does not require the use of a wetting agent. A wetting agent can nevertheless be used to increase the hydrophilicity of a hydrophilic binder in a similar manner to its action in combination with a hydrophobic binder. This means that the MMVF substrate will absorb a higher volume of water than if the wetting agent is not present. Any hydrophilic binder can be used.

The binder may be a formaldehyde-free aqueous binder composition comprising: a binder component (A) obtainable by reacting at least one alkanolamine with at least one carboxylic anhydride and, optionally, treating the reaction product with a base; and a binder component (B) which comprises at least one carbohydrate, as disclosed in WO2004/007615. Binders of this type are hydrophilic.

WO97/07664 discloses a hydrophilic substrate that obtains its hydrophilic properties from the use of a furan resin as a binder. The use of a furan resin allows the abandonment of the use of a wetting agent. Binders of this type may be used in the present invention.

WO07129202 discloses a hydrophilic curable aqueous composition wherein said curable aqueous composition is formed in a process comprising combining the following components:

(a) a hydroxy-containing polymer, (b) a multi-functional crosslinking agent which is at least one selected from the group consisting of a polyacid, salt(s) thereof and an anhydride, and (c) a hydrophilic modifier;

wherein the ratio of (a):(b) is from 95:5 to about 35:65.

The hydrophilic modifier can be a sugar alcohol, monosaccharide, disaccharide or oligosaccharide. Examples given include glycerol, sorbitol, glucose, fructose, sucrose, maltose, lactose, glucose syrup and fructose syrup. Binders of this type can be used in the present invention.

Further, a binder composition comprising:

a) a sugar component, and b) a reaction product of a polycarboxylic acid component and an alkanolamine component, wherein the binder composition prior to curing contains at least 42% by weight of the sugar component based on the total weight (dry matter) of the binder components may be used in the present invention, preferably in combination with a wetting agent.

Binder levels are preferably in the range 0.5 to 5 wt %, preferably 2 to 4 wt %, based on the weight of the MMVF substrate.

Levels of wetting agent are preferably in the range 0 to 1 wt %, based on the weight of the MMVF substrate, in particular in the range 0.2 to 0.8 wt %, especially in the range 0.4 to 0.6 wt %.

The MMVF product may be made by any of the methods known to those skilled in the art for production of MMVF growth substrate products. In general, a mineral charge is provided, which is melted in a furnace to form a mineral melt. The melt is then formed into fibres by means of centrifugal fiberisation e.g. using a spinning cup or a cascade spinner, to form a cloud of fibres. These fibres are then collected and consolidated. Binder and optionally wetting agent are usually added at the fiberisation stage by spraying into the cloud of forming fibres. These methods are well known in the art.

The MMVF substrate used as storm water delay device in the present invention preferably has a density in the range of 60 to 200 kg/m$^3$, preferably in the range of 75 to 150 kg/m$^3$, such as around 80 kg/m$^3$. The density of the MMVF substrate is the density of the MMVF substrate as such, that is the density of the MMVF substrate excluding a passage, if present. The optional passage is not taken into account when calculating the density of the MMVF substrate.

The advantage of this density is that the MMVF substrate has a relatively high compression strength. This is important as the MMVF substrate may be installed in a position where people or vehicles need to travel over the ground in which the MMVF substrate is positioned. Optionally, a force distribution plate is positioned on top of the MMVF substrate in order to distribute the force upon the MMVF substrate. Preferably such a force distribution plate is not required due to the density of the MMVF substrate.

The MMVF substrate may be 5 m to 100 m wide, 5 m to 100 m long and 1 m to 5 m height. The actual volume and shape of the MMVF substrate can be chosen appropriately according to the amount of water that it is likely to be required to handle. The MMVF substrate preferably has a height of at least 1 m so as to provide a significant distance between the top of the MMVF substrate and the bottom of the MMVF substrate. If the height is less than this, the delay of the flow of the water will be insufficient. The height of the MMVF substrate is preferably not more than 5 m high. In general terms, it is difficult to install a MMVF substrate that has a height greater than 5 m due to the depth of the hole required for installation.

The storm water delay device may comprise more than one MMVF substrate, wherein the multiple MMVF substrates are in fluid communication with each other, such as 2-100 MMVF substrates, preferably 5-20 MMVF substrates. Preferably there is physical contact between adjacent MMVF substrates, that is, they abut each other. If the storm water delay device comprises multiple MMVF substrates, then the device will also comprise at least one first conduit and at least one second conduit. It is not necessary for there to be a first conduit and a second conduit in direct fluid communication with each MMVF substrate, provided that the storm water delay device as a whole comprises at least one first conduit and at least one second conduit in fluid communication.

The volume of the MMVF substrate(s) is preferably in the range 25 to 50,000 m$^3$, preferably 100 to 30,000 m$^3$. The precise volume is chosen according to the volume of water which is expected to be managed.

Preferably the MMVF substrate has a rectangular or square cross-section which makes it easy to manufacture and reduces production wastage of the MMVF substrate. Further, MMVF substrates with a rectangular or square cross-section can be abutted so as to maximise the area of fluid communication between two MMVF substrates. Alternatively the cross-section may be circular, triangular or any convenient shape.

Preferably the cross-sectional area of the MMVF substrate is substantially uniform along the length. Substantially uniform means that the cross-sectional area is within 10% of the average cross-sectional area, preferably within 5%, most preferably within 1%.

Preferably the first and second conduits are each a pipe. An advantage of a pipe is that it is hollow and can therefore freely transport water underground to and from the MMVF substrate. Further, the wall of the pipe prevents debris from entering the pipe.

Preferably the first open end of the first conduit is at least partially embedded in the MMVF substrate. The advantage of embedding the first open end of the first conduit in the MMVF substrate is that water can flow along the first conduit, and directly into the MMVF substrate. It is, of course, envisaged that the MMVF substrate may abut the conduit, preferably a pipe, through which water will flow, in order to achieve this fluid communication. It is preferable however, for efficiency of fluid transfer for the first conduit to be at least partially embedded into the MMVF substrate.

Preferably the first open end of the second conduit is at least partially embedded in the MMVF substrate. The advantage of embedding the first open end of the second conduit in the MMVF substrate is that water can flow from the MMVF substrate, and directly into the second conduit. It is, of course envisaged that the MMVF substrate may abut the conduit, preferably a pipe, through which water will flow, in order to achieve this fluid communication. It is preferable however for efficiency for the conduit to be at least partially embedded into the MMVF substrate.

The embedded part of the first and/or second conduit may be provided with an aperture in its outer wall, preferably more than one aperture. The presence of one or more apertures has the advantage of there being a greater area through which the water can flow into the MMVF substrate.

Preferably the MMVF substrate has opposed first and second ends and the first conduit is in fluid communication with the first end of the MMVF substrate and the second conduit is in fluid communication with the second end of the MMVF substrate. In use, the first conduit is arranged such that water can flow into the first end of the MMVF substrate and the second conduit is arranged such that water can flow out of the second end of the MMVF substrate. When the MMVF substrate is a cuboid, MMVF substrate is preferably arranged such that the opposed first and second ends are substantially vertical. Substantially vertical means that the opposed ends are less than 20° from vertical, more preferably less than 10° from vertical, most preferably less than 5° from vertical.

Preferably there is provided within the MMVF substrate, a first passage in fluid communication with the first open end of the first conduit, wherein the passage extends from the first open end of the first conduit towards the second end of the MMVF substrate. An advantage of the first passage is that it results in there being a greater surface area through which water can flow into the MMVF substrate, which will increase the rate of absorption of the water into the MMVF substrate. This means that the MMVF substrate will be able to absorb water at a higher rate.

Preferably there is provided within the MMVF substrate, a second passage in fluid communication with the first open end of the second conduit, wherein the passage extends from the first open end of the second conduit towards the first end of the MMVF substrate. An advantage of the second passage is that the water will be directed into the second conduit more easily than if there were no second passage, as there is provided a greater surface area through which water can flow from the MMVF substrate into the second conduit.

The first and second passage may each extend, for instance, 10% to 100% of the way through the MMVF substrate, preferably 20% to 99% of the way through the MMVF substrate, more preferably 50% to 99% of the way through the MMVF substrate, most preferably 80% to 95% of the way through the substrate. The advantage of the passage is that there is a greater area through which the water can flow into the MMVF substrate. The passage may have any cross-sectional shape, preferably circular, triangular or square. The passages may be formed by embedding the first and second conduit into the MMVF substrate. Preferably the conduit is a pipe which has at least one aperture in that portion of the pipe which is embedded in the MMVF substrate. The pipe is preferably a perforated plastic pipe, such as a PVC pipe. The pipe gives strength to the drain and prevents the passage from becoming closed. The pipe is perforated to allow the water to drain into the passage. The embedded pipe provides support to the passage to make it more resistant to pressure. In the absence of a pipe, the passage could become closed due to pressure on the MMVF substrate, such as vehicles moving over the MMVF substrate.

Preferably the cross-sectional area of the first open end of the first passage is 0.5% to 15% of the cross-sectional area of the first end of the MMVF substrate, preferably 1% to 10%.

Preferably the cross-sectional area of the first open end of the second passage is 0.5% to 15% of the cross-sectional area of the second end of the MMVF substrate, preferably 1% to 10%.

The openings preferably take up such a small percentage of the cross-sectional area of the ends of the device so that the vast majority of the MMVF substrate can be used to buffer the amount of water that is to be conveyed. The larger the proportion of the device that is made up of MMVF substrate, the greater the volume of water that can be buffered by a device of a given cross-sectional area.

The cross-sectional areas of each of the first and second passages are preferably substantially uniform along their length. Substantially uniform means that the cross-sectional area is within 10% of the average cross-sectional area, preferably within 5%, most preferably within 1%. If necessary however, the cross-sectional area can be varied according to the requirements of the passage to be smaller or larger. A smaller passage will allow a smaller amount of water to enter or leave the MMVF substrate due to the passage having a smaller surface area.

The first and second passages are preferably configured so that each passage takes the most direct route towards the opposite end of the MMVF substrate. This is for ease of manufacture. The first and second passages are preferably substantially horizontal. The first passage may be sloped downwards from the first opening so that gravity causes water to flow along the passage and thus increases the surface area of the passage through which water is absorbed into the MMVF substrate. The second passage may be sloped downwards towards the second opening so that gravity causes water to flow along the passage towards the second opening. The slope of the first and second passages may be 0.5 to 5° from horizontal, preferably 1 to 4° from horizontal, most preferably 1 to 3° from horizontal.

The first and second passages may independently have a triangular cross-sectional area. In this case the base of the triangle is preferably parallel with the base of the MMVF substrate. Alternatively the first and second passages may independently have a semi-circular cross-sectional area. Again, in this case the base of the MMVF substrate is preferably parallel with the base of the semicircle. Alternatively, the first and second passage may independently have a circular or a rectangular cross-sectional area. The shapes of the cross-sectional areas of the first and second passages may be the same, or different.

The device may comprise a first part in contact with a second part, wherein a passage is disposed between the first part and the second part. This can be achieved by providing a first part which is preformed so that it has a groove along the length of the MMVF substrate, and when the first part and second parts are placed together, the passage is formed by the groove and the second part. Alternatively the second part may have the groove. Alternatively, both the first and second part may have a groove and the grooves may be lined up to form the passage when the first and second parts are joined together. The groove or grooves may be of any shape, as required to form the passage. The groove or grooves may therefore have a cross-section which is semi-circular, triangular, rectangular or the like.

The first and second parts of the MMVF substrate may simply be placed in contact, or they may be connected, e.g. using an adhesive. In order to form a device with a first and a second passage, the device may be formed of three parts where each passage is formed by a groove between the first and second parts and a groove between the second and third parts.

The storm water delay device may be formed of two MMVF substrates on top of each other. In this embodiment, each MMVF substrate has a passage which is offset in a first direction. In use, the two MMVF substrates are positioned on top of each other with the passage disposed in the top half of the top MMVF substrate and the bottom half of the bottom MMVF substrate. This maximises the distance between the passage of the top MMVF substrate and the passage of the bottom MMVF substrate. This also means that a unit MMVF substrate with a passage disposed in one direction can be produced and used to form a storm water delay device.

Preferably the water holding capacity of the MMVF substrate is at least 80% of the volume of the substrate, such as 80-99%, preferably 85-95%. The greater the water holding capacity, the more water can be stored for a given substrate volume. The water holding capacity of the MMVF substrate is high due to the open pore structure and the MMVF substrate being hydrophilic.

Preferably the amount of water that is retained by the MMVF substrate when it emits water is less than 20% vol, such as less than 10% vol, preferably less than 5% vol based on the volume of the substrate. The water retained may be 2 to 20% vol, such as 5 to 10% vol. The lower the amount of water retained by the MMVF substrate, the greater the capacity of the MMVF substrate to take on more water. Water may leave the MMVF substrate by water being conveyed by the second conduit to a water collection point and/or by dissipating into the ground when the surrounding ground is dry and the capillary balance is such that the water dissipates into the ground.

Preferably the buffering capacity of the MMVF substrate, that is the difference between the maximum amount of water that can be held, and the amount of water that is retained when the MMVF substrate gives off water is at least 60% vol, preferably at least 70% vol, more preferably at least 80% vol, based on the volume of the substrate. The buffering capacity may be 60 to 90% vol, such as 60 to 85% vol. The advantage of such a high buffering capacity is that the MMVF substrate can buffer more water for a given substrate volume, that is the MMVF substrate can store a high volume of water when required, and release a high volume of water into the surrounding ground when the ground has dried out. The buffering capacity is so high because MMVF substrate requires a low suction pressure to remove water from the MMVF substrate.

The water holding capacity, the amount of water retained and the buffering capacity of the MMVF substrate can each be measured in accordance with EN 13041-1999.

The present invention relates to the use of a device according to the first aspect of the invention as a storm water delay device, wherein the device is positioned in the ground in such a way that the first conduit is at a greater height than the second conduit, whereby water flows along the first conduit and is absorbed by the MMVF substrate, and water leaves the MMVF substrate via the second conduit.

Preferably the second conduit is in fluid communication with a water collection point, preferably a tank or reservoir.

In use, the MMVF substrate is positioned in the ground and is preferably buried within the ground. Preferably the MMVF substrate is completely covered with earth. Earth includes sediment, sand, clay, dirt, gravel and the like. For example, the MMVF substrate may be buried under at least 5 cm of earth, such as at least 20 cm of earth, more preferably at least 40 cm of earth, most preferably at least 50 cm of earth.

An advantage of using the device of the present invention is that it delays water reaching a water collection point, such as a tank or a reservoir. When there is heavy rainfall, a reservoir or tank may become overwhelmed by a sudden rush of water. Using a device according to the present invention delays the arrival of the rush of water at the reservoir or tank and thus helps prevent flooding.

In use, rainwater is collected, such as by guttering around buildings, and rainwater collection systems, flows into the top of the MMVF substrate via the first conduit. The rainwater is absorbed by the body of the MMVF substrate and gravity causes the water to flow towards the bottom of the MMVF substrate. The water then leaves the MMVF substrate via the second conduit. The first conduit is at a greater height than the second conduit so that the water has to flow through at least some of the height of the MMVF substrate before leaving the MMVF substrate via the second conduit. The height difference between the first and second conduit is preferably as great as possible to maximise the amount of the MMVF substrate that the water has to flow through. This maximises the time delay for a given size of MMVF substrate.

It is not necessary to wrap the MMVF substrate of the present invention in any geo-textile material on installation because the MMVF substrate acts like a filter itself in order to prevent any contaminant such as earth entering the device and blocking the flow of water through the device.

There is provided a method of installing a storm water delay device, the method comprising positioning a device according to the first aspect of the invention in the ground in such a way that the first conduit is at a greater height than the second conduit, wherein the first conduit is in fluid communication with a source of water and wherein the second conduit is in fluid communication with a water collection point.

In this method, the water collection point is preferably a tank or a reservoir.

Preferably the device is covered in earth.

There is provided a method of delaying of delaying the arrival of water at a water collection point, the method comprising providing a device according to the first aspect of the invention, positioning the device in the ground in such a way that the first conduit is at a greater height than the second conduit, wherein water flows along the first conduit and is absorbed by the MMVF substrate, and water leaves the MMVF substrate via the second conduit and is conveyed to the water collection point.

DETAILED DESCRIPTION OF FIGURES

Figure 1:
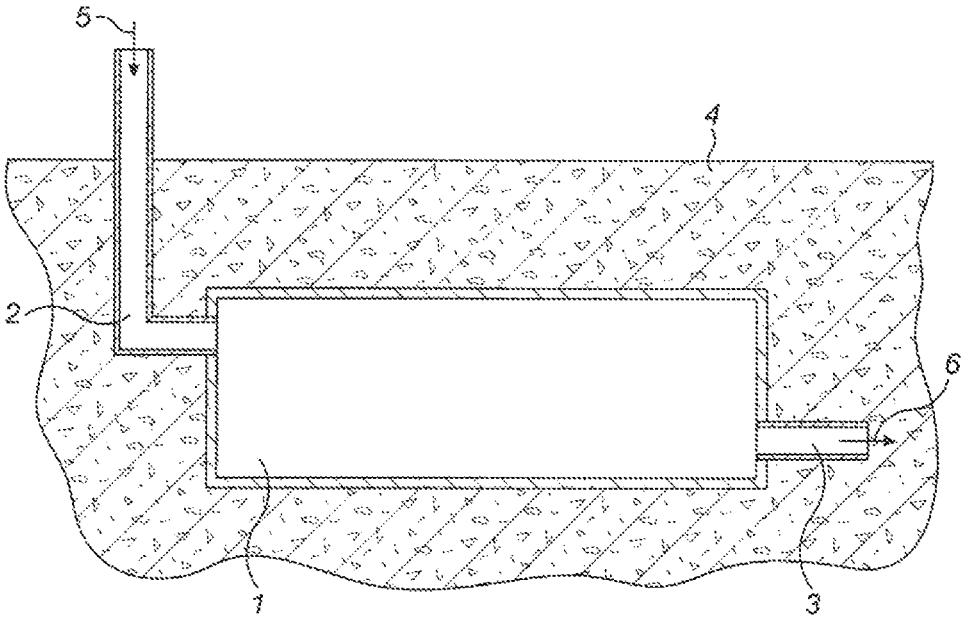
FIG. 1 shows a cross-sectional view of a device comprising one MMVF substrate

FIG. 1 shows a cross-sectional view of a MMVF substrate 1, in fluid connection with a first conduit 2 and a second conduit 3, where the first conduit is positioned higher than the second conduit. The first conduit 2 is in fluid communication with a water source 5. The second conduit 3 is in fluid communication with a water collection point 6. The device is positioned in the ground 4. The first and second conduits are shown at opposite ends of the MMVF substrate, but they could also be on the same end of the MMVF substrate, or different ends of the MMVF substrate.

Figure 2:
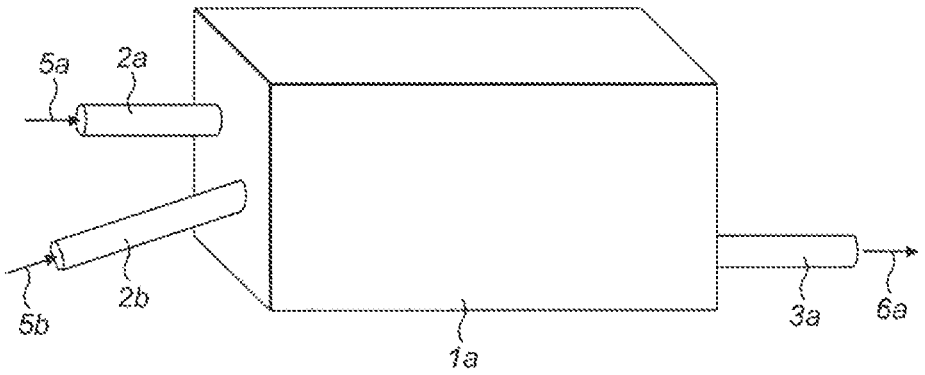
FIG. 2 shows a perspective view of a device comprising two first conduits

FIG. 2 shows a MMVF substrate 1*a* in fluid communication with a two first conduits 2*a* and 2*b*. Each first conduit 2*a* and 2*b* is in fluid communication with water source 5*a* and 5*b* respectively. The second conduit 3*a* is in fluid communication with the MMVF substrate 1*a* and with a water collection point 6*a*. The first conduits are both positioned higher than the second conduit. The first conduits may be at different heights and they may be on the same, or a different side of the MMVF substrate. The first and second conduits are shown at opposite ends of the MMVF substrate, but they could also be on the same end of the MMVF substrate.

Figure 3:
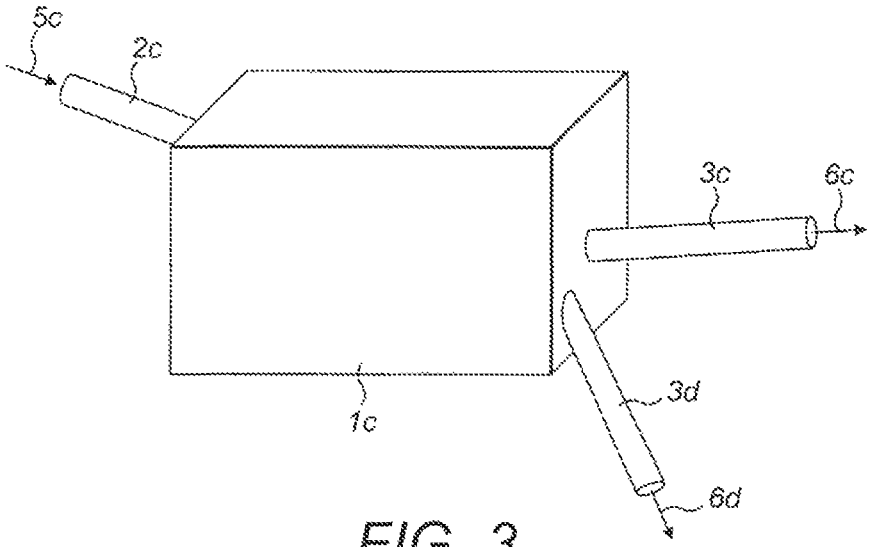
FIG. 3 shows a perspective view of a device comprising two second conduits

FIG. 3 shows a MMVF substrate 1*c* in fluid communication with a first conduit 2*c*. The first conduit 2*c* is in fluid communication with water source 5*c*. There are two second conduits, 3*c* and 3*d* in fluid communication with the MMVF substrate 1*c*. Each of the two second conduits 3*c* and 3*d* is in fluid communication with water collection points 6*c* and 6*d* respectively. The first conduit is positioned higher than the second conduits. The second conduits may be at different heights and they may be on the same, or a different side of the MMVF substrate. The first and second conduits are shown at opposite ends of the MMVF substrate, but they could also be on the same end of the MMVF substrate, or different ends of the MMVF substrate.

Figure 4:
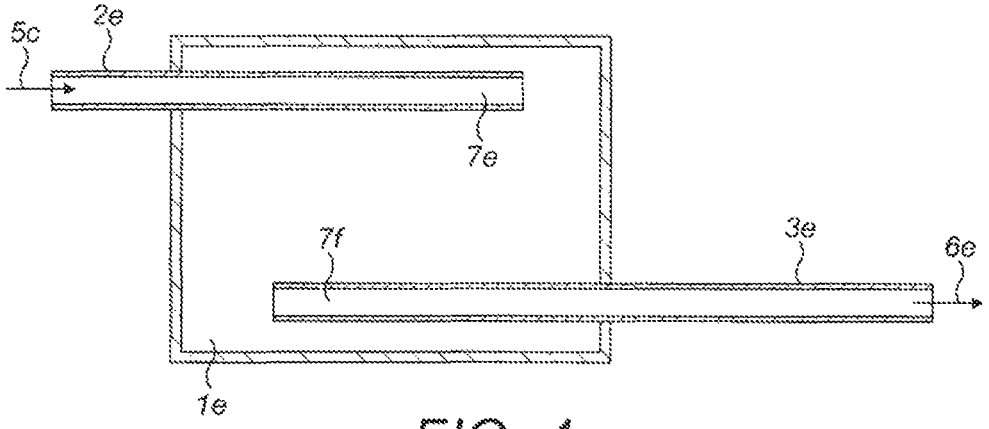
FIG. 4 shows a cross-sectional view of a device with first and second passages

FIG. 4 shows a cross-sectional view of a MMVF substrate 1*e* in fluid communication with a first conduit 2*e* and a second conduit 3*e*. A first passage 7*e* extends from the first conduit 2*e* into the MMVF substrate 1*e*. A second passage 8*e* extends from the second conduit 3*e* into the MMVF substrate 1*e*. Both passages are shown as extending the majority of the way through the MMVF substrate, but may extend only partly into the MMVF substrate. Each of the passages preferably has apertures to allow the water to flow into or out of the MMVF substrate.

Figure 5:
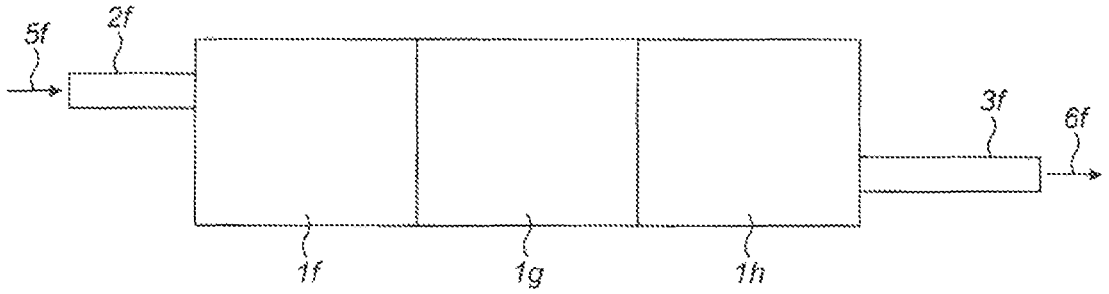
FIG. 5 shows a cross-sectional view of a device comprising three MMVF substrates

FIG. 5 shows a cross-sectional view of three MMVF substrates 1*f*, 1*g* and 1*h* in fluid communication with each other. A first conduit 2*f* is in physical contact with the MMVF substrate 1*f* and a water source 5*f*. A second conduit 3*f* is in physical contact with the MMVF substrate 1*h* and a water collection point 6*f*. The first conduit 2*f* and the second conduit 3*f* are both in fluid communication with each of the MMVF substrates 1*f*, 1*g* and 2*h*. Water will enter the device via the first conduit and leave the device via the second conduit. There may be more MMVF substrates, or more first and second conduits as required.

Figure 6:
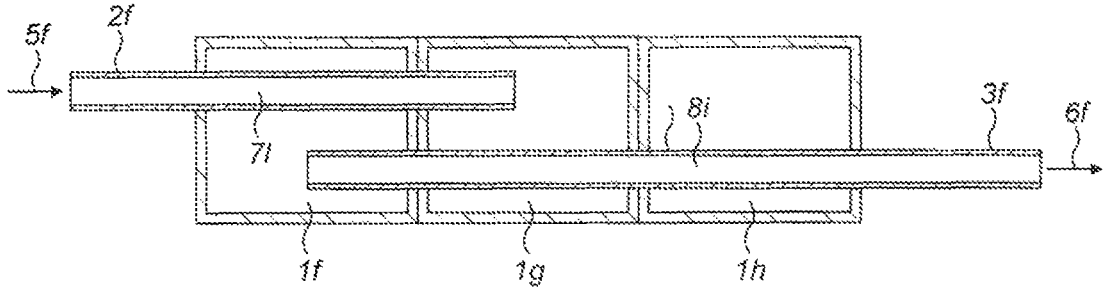
FIG. 6 shows a cross-sectional view of a device comprising three MMVF substrates and first and second passages.

FIG. 6 shows a cross-sectional view of three MMVF substrates 1*i*, 1*j* and 1*k* in fluid communication with each other. A first conduit 2*i* is in physical contact with the MMVF substrate 1*i* and a water source 5*i*. A second conduit 3*i* is in physical contact with the MMVF substrate 1*k* and a water collection point 6*i*. The first conduit 2*i* and the second conduit 3*i* are both in fluid communication with each of the MMVF substrates 1*i*, 1*j* and 1*k*. Water will enter the device via the first conduit and leave the device via the second conduit. There may be more MMVF substrates, or more first and second conduits as required. A first passage 7*i* extends from the first conduit 2*i* into the MMVF substrate 1*i*. A second passage 8*i* extends from the second conduit 3*i* into the MMVF substrate 1*k*. Each passage may extend into all three MMVF substrates, or into only one or two of them. Each of the passages preferably has apertures to allow the water to flow into or out of the MMVF substrate.

Figure 7:
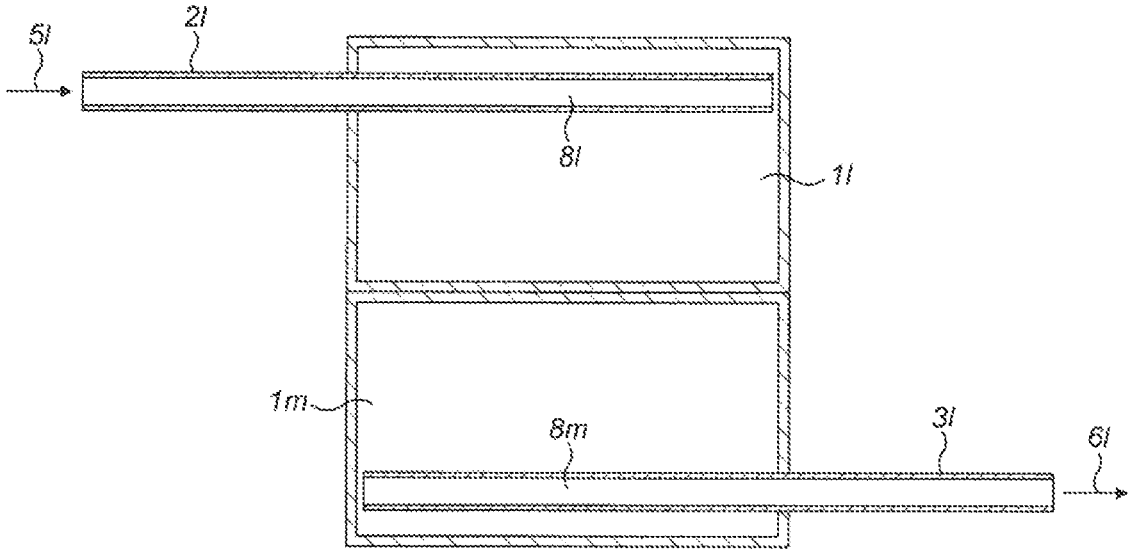
FIG. 7 shows a cross-sectional view of two MMVF substrates

FIG. 7 shows a cross-sectional view of two MMVF substrates 1*l* and 1*m* with 1*l* on top of 1*m*. The first conduit 2*l* is in fluid communication with the MMVF substrate 1*l* and a water source 5*l*. The second conduit 3*l* is in fluid communication with the MMVF substrate 8*m* and a water collection point 6*l*. Each MMVF substrate has a passage, 8*l* and 8*m* respectively. Passage 8*l* is in the top half of MMVF substrate 1*l* and passage 8*m* is in the bottom half of MMVF substrate 1*m*. This shows that two MMVF substrates, each with a passage can be used to form a storm water delay device.

Multiple MMVF substrates may be arranged in any way, provided that they are each in fluid communication with at least one first conduit and at least one second conduit.

It will be appreciated by the skilled person that any of the preferred features of the invention may be combined in order to produce a preferred method, product or use of the invention.

The invention claimed is:

1. A device comprising a coherent man-made vitreous fibre substrate (MMVF substrate) and at least one first conduit and at least one second conduit, each conduit having first and second open ends, wherein the MMVF substrate comprises man-made vitreous fibres bonded with a cured binder composition, wherein the first open end of the first conduit and the first open end of the second conduit are each independently in fluid communication with the MMVF substrate, wherein the first conduit is at a greater height than the second conduit, wherein at least a portion of the MMVF substrate is disposed between the first and second conduits, wherein two or more outer surfaces of the MMVF substrate is adapted for direct contact with the ground so that water held in the MMVF substrate passes through the two or more outer surfaces and thereby dissipates directly into the ground, wherein the first open end of each of the first and second conduits is at least partially embedded in the MMVF substrate.

2. A device according to claim 1 wherein the volume of the device is 25 to 50,000 $m^3$.

3. A device according to claim 2 wherein the volume of the device is 100 to 30,000 $m^3$.

4. A device according to claim 1, wherein the MMVF substrate has a density in the range 60 to 200 $kg/m^3$.

5. A device according to claim 4, wherein the MMVF substrate has a density in the range 75 to 150 $kg/m^3$.

6. A device according to claim 1, wherein the MMVF substrate comprises a wetting agent.

7. A device according to claim 1, wherein the MMVF substrate has opposed first and second ends and the first conduit is in fluid communication with the first end of the MMVF substrate and the second conduit is in fluid communication with the second end of the MMVF substrate.

8. A device according to claim 7, wherein the MMVF substrate comprises a first passage in fluid communication with the first open end of the first conduit, wherein the passage extends from the first open end of the first conduit towards the second end of the MMVF substrate.

9. A device according to claim 7, wherein the MMVF substrate comprises a second passage in fluid communication with the first open end of the second conduit, wherein the passage extends from the first open end of the second conduit towards the first end of the MMVF substrate.

10. A method for using the device according to claim 1 as a storm water delay device, the method comprising positioning the device in the ground in such a way that the first conduit is at a greater height than the second conduit, whereby water flows along the first conduit and is absorbed by the MMVF substrate, and water leaves the MMVF substrate via the second conduit.

11. The method according to claim 10, wherein the second conduit is in fluid communication with a water collection point.

12. The method according to claim 11, wherein the water collection point is a tank or a reservoir.

13. A method of installing a storm water delay device, the method comprising positioning a device according to claim 1 in the ground in such a way that the first conduit is at a greater height than the second conduit, wherein the first conduit is in fluid communication with a source of water and wherein the second conduit is in fluid communication with a water collection point.

14. A method according to claim 13 wherein the device is covered with earth.

15. A method of delaying the arrival of water at a water collection point, the method comprising providing a device according to claim 1, positioning the device in the ground in such a way that the first conduit is at a greater height than the second conduit, wherein water flows along the first conduit and is absorbed by the MMVF substrate, and water leaves the MMVF substrate via the second conduit and is conveyed to the water collection point.

16. A method according to claim 15, wherein the water collection point is a tank or a reservoir.

17. A device according to claim 1, wherein the at least one first conduit is positioned at a greater height than the at least one second conduit so that water leaves the MMVF substrate through the at least one second conduit.

18. A device according to claim 1, wherein the one or more outer surfaces of the MMVF substrate constitute a bulk of a surface area defining the one or more outer surfaces.

19. A device according to claim 1, wherein all of the outer surfaces of the MMVF substrate is adapted for direct contact with the ground so that water held in the MMVF substrate passes through the one or more outer surfaces and thereby dissipates directly into the ground.

* * * * *